United States Patent [19]

Aloisio, Jr. et al.

[11] 4,439,632

[45] * Mar. 27, 1984

[54] BONDED SHEATH CABLE

[75] Inventors: Charles J. Aloisio, Jr., Atlanta; George S. Brockway, II, Lawrenceville; Alvin C. Levy, Atlanta; Randy G. Schneider, Marietta; George M. Yanizeski, Roswell, all of Ga.

[73] Assignees: Western Electric Co., Inc., New York, N.Y.; Bell Telephone Laboratories, Inc., Murray Hill, N.J.

[ * ] Notice: The portion of the term of this patent subsequent to May 4, 1999 has been disclaimed.

[21] Appl. No.: 368,183

[22] Filed: Apr. 14, 1982

Related U.S. Application Data

[63] Continuation of Ser. No. 225,082, Jan. 14, 1981, Pat. No. 4,328,394.

[51] Int. Cl.[3] ..... H01B 7/18

[52] U.S. Cl. ..... 174/106 D; 174/107

[58] Field of Search ..... 174/102 D, 106 R, 106 D, 174/107

[56] References Cited

U.S. PATENT DOCUMENTS

| | | | |
|---|---|---|---|
| 2,589,700 | 3/1952 | Johnstone | 174/106 |
| 3,340,353 | 9/1967 | Milder | 174/106 |
| 3,376,378 | 4/1968 | Bullock | 174/107 |
| 3,459,877 | 8/1969 | Bullock et al. | 174/107 |
| 3,551,586 | 12/1970 | Dembiak et al. | 174/107 |
| 3,629,489 | 12/1971 | Jachimowicj et al. | 174/107 |
| 3,681,515 | 8/1972 | Mildner | 174/107 |
| 3,703,605 | 11/1972 | Dembiak et al. | 174/107 |
| 3,711,621 | 1/1973 | Jachimowicj | 174/23 R |
| 3,745,232 | 7/1973 | Johnson et al. | 174/107 |
| 3,824,330 | 7/1974 | Lang | 174/102 D |
| 3,826,862 | 7/1974 | Ichiba et al. | 174/102 R |
| 4,035,211 | 7/1977 | Bill et al. | 156/54 |
| 4,109,099 | 8/1978 | Dembiak et al. | 174/107 |
| 4,132,857 | 1/1979 | Scarola et al. | 174/107 |
| 4,151,365 | 4/1979 | Hacker | 174/107 |
| 4,292,463 | 9/1981 | Bow et al. | 174/107 |
| 4,322,574 | 3/1982 | Bow et al. | 174/107 |
| 4,328,394 | 5/1982 | Aloisio, Jr. et al. | 174/106 D |

FOREIGN PATENT DOCUMENTS

| | | | |
|---|---|---|---|
| 2746929 | 4/1978 | Fed. Rep. of Germany | 174/107 |
| 1419843 | 10/1964 | France | 174/107 |
| 6410915 | 9/1964 | Netherlands | 174/106 |

OTHER PUBLICATIONS

Metcalf, E. D., "A Bonded Non-Corrugated Aluminum/Polyethylene Sheathing System for Telephone Cable"; Proceedings of the 21st International Wire and Cable Symposium; Dec. 5-7, 1972; pp. 235-239.

Yanizeski, G. M. et al., "Predicting Fracture Creep; and Stiffness Characteristics of Cable Jackets from Material Properties", Proceedings of the 25th International Wire and Cable Symposium; Nov. 16-18, 1976, pp. 272-280; Bell Laboratories.

Brockway, G. S. et al., "Elastic State of Stress in a Stalpeth Cable Jacket Subjected to Pure Bending", Bell System Technical Journal vol. 57, No. 1, Jan. 1978.

*Primary Examiner*—J. V. Truhe
*Assistant Examiner*—Morris H. Nimmo
*Attorney, Agent, or Firm*—F. W. Somers

[57] ABSTRACT

A cable which is capable of being made in a large pair size and yet which has excellent mechanical properties that maintain its integrity notwithstanding extremes in temperature during installation and shipping as well as during the rigors of installation includes a sheath system having a corrugated steel outer shield that is adhesively bonded to a plastic jacket. The corrugated steel shield which is formed to have a longitudinal overlapped seam that is preferably unsealed encloses an aluminum inner shield that in turn encloses a multiconductor core. Advantageously, the sheath system includes a plastic jacketing material which is capable of resisting biaxial stresses which are aggravated in a bonded sheath system. This results in jacket integrity about the longitudinal seam of the outer shield notwithstanding a notched cross-section and an unsupported bridged portion of the plastic jacket adjacent to the seam. Of additional benefit is a further characterization of the plastic as being one which because of its relatively low elastic modulus at conventional extrusion times and temperatures is caused to fill substantially the corrugations of the outer shield. The jacket plastic forms a surface-to-surface bond with the shield that is sufficient to prevent delamination of the outer shield and the jacket and to prevent buckling of the jacket during exposure to temperature extremes.

9 Claims, 9 Drawing Figures

BONDED SHEATH CABLE

This is a continuation of application Ser. No. 06/225,082 filed Jan. 14, 1981, now U.S. Pat. No. 4,328,394.

TECHNICAL FIELD

This invention relates to a bonded sheath cable, and more particularly, to a cable having a sheath system which includes a corrugated metallic shield which is bonded to a plastic outer jacket having sufficiently high biaxial stress resistant properties to prevent jacket splitting in the vicinity of a longitudinal seam of the shield with the bond between the shield and the jacket being sufficient to resist buckling during installation at low temperatures.

BACKGROUND OF THE INVENTION

In recent years, several factors have necessitated that relatively large pair size communications cable cores be protected with a cover that exhibits an improved mechanical performance. The cover which is commonly referred to as a sheath system generally includes layers of metal and plastic which are disposed concentrically about the core. Relatively large pair size cores, e.g., 3600 pairs, have increased in popularity, but their size has resulted in cable sheath buckling and/or rupture, particularly in cold weather installations and in the use of high production placing equipment.

Sheath buckling is characterized by distortions, such as ripples, for example, in the sheath that occur when the cable is bent or twisted. These ripples can snag other materials which the cable engages or can become abraded during installation. In some instances, the sheath ruptures and hence no longer protects the core.

These cables usually include a multi-conductor core, an inner metallic tube which is called a shield and which provides protection against external electrical interference, an outer metallic shield and a plastic jacket. Cables of this construction are well known in the industry and have been referred to as Stalpeth cables. See U.S. Pat. No. 2,589,700 which issued on Mar. 18, 1952, in the name of H. G. Johnstone. Each of the shields is usually formed by wrapping a metallic strip about the core to form a longitudinally extending seam. The seam for the outermost shield is usually overlapped with overlapped portions being soldered together. Typically, the shields are corrugated transversely of the longitudinal axis of the cable to facilitate bending of the cable.

It has been determined that an effective method for improving the buckling performance of Stalpeth cable is to increase the cross-sectional stiffness by tightening the cable cross-section. Of course, any tightness in the cable must be accomplished without overly compressing the core, which could affect the electrical performance of the cable. Also, changes to jacket thickness, to flooding compounds, and to jacketing materials have been investigated, but none of these has significantly improved the performance.

In addition to sheath buckling, another area of concern is the diffusion of water vapor through the plastic jacket which may result in an undesirably high moisture level inside the sheath on a cable. See for example E. D. Metcalf "A Bonded Non-Corrugated Aluminum-Polyethylene Sheathing System For Telephone Cable" pp. 235–239 *Proceedings 24th International Wire and Cable Symposium* December 5–7, 1972. A relatively high moisture level will have a detrimental effect on the transmission characteristics of the cable. The effectiveness of the shield which is made from a single metallic strip formed longitudinally about the cable is enhanced greatly if its resultant seam is sealed. The most effective seal from the moisture barrier point of view is one in which a metal bond exists such as a welded or a soldered seal; however, despite the soldering of the outer shield seen in Stalpeth cable, moisture is able to penetrate the sheath and to enter the core through holes and gaps in the soldered seam.

Besides its inability to prevent the build up of undesirably high moisture levels internally, conventional Stalpeth cable prevents manufacturing difficulties. A continuously soldered seam is difficult to achieve at economical manufacturing speeds because of mismatching of overlapping corrugated portions which comprise the seam. Since the soldering of the seam may require frequent stops and starts of a manufacturing line in order to repair gaps in the seam, the soldering operation must be performed on a separate line from the jacket extrusion which must be continuous. Also, in order to prevent damage to the plastic conductor insulation from the high temperatures of soldering, sufficient core wrap must enclose the conductors. This increases the diameter of the core and results in a core which is less compact than one without the additional protective wrap.

By adhesively bonding the plastic jacket to the outer corrugated shield, it has been found that the resistance of the cable, which is called bonded sheath cable, to moisture diffusion is substantially increased. See, for example, U.S. Pat. No. 3,340,353. Maximum diffusion resistance is obtained by bonding the plastic jacket to the coated steel and by bonding overlapping portions of the shield along the longitudinal seam. A study has been made which indicates that a bonded sheath cable should exhibit an improved buckling performance; however, the prior art is seemingly devoid of a cable having a bonded sheath system which simultaneously addresses the problems of moisture diffusion and low temperature buckling.

Bonded Stalpeth cable does offer significant manufacturing advantages over standard Stalpeth. It does not require the soldering of the overlapped portions of the outer shield. Without the necessity of soldering, manufacturing temperatures are reduced from about 300°–400° C. to about 100° C. in the core thereby reducing the probability of damaging the conductor insulation and obviating the need for additional protective wrap for the core. Moreover, the sheath system for bonded sheath cable can be formed in a single line whereas it will be recalled that the standard Stalpeth cable was shielded and then jacketed on another line. Manufacturing difficulties do arise when attempting to nest corrugations of overlapped portions of a corrugated shield to achieve a sealed seam, but this problem has been overcome by flowing adhesive-like material between the overlapping portions as is disclosed in U.S. Pat. No. 4,035,211 which issued on July 12, 1977 in the names of R. G. Bill and E. L. Franke, Jr.

While the use of a bonded sheath which includes a corrugated outer shield overcomes some problems, it may result in an undesirable stressing of the jacket. In fact, G. S. Brockway and G. M. Yanizeski in an article "Elastic State of Stress in a Stalpeth Cable Jacket Subjected to Pure Bending" which was published in Vol. 57 No. 1 January 1978 issue of the *Bell System Technical Journal* conclude that the probability of spontaneous cracking in a cable jacket is increased by the adherence of the jacket to the soldered steel layer. In an unbonded cable sheath, bending forces cause the jacket to be subjected to uniaxial stresses in a longitudinal direction; however, in a bonded sheath, not only is the jacket stressed in a longitudinal direction, but a significant hoop stress is developed. Unfortunately, this kind of stressing, which is termed biaxial, causes a substantial reduction in the elongation properties of some jacketing materials over those exhibited under uniaxial stress. If the longitudinal seam is left unbonded, the capability of the jacket plastic to resist biaxial stress is especially important since the elongation becomes concentrated in the region where the jacket bridges the seam and because the jacket can be notched by a longitudinal edge of the shield.

The problem of biaxial stressing in bonded sheath cables has not been a problem in the past because bonded sheath cables typically have included an outer jacket bonded to aluminum which is a relatively soft metal. The softness of such a metal allows it to yield to some degree to relieve at least partially any stress concentration. This benefit is not available in bonded Stalpeth cable, for example, in which the outer jacket is bonded to a relatively hard metal such as steel.

Another concern that must be met when using bonded sheath cable is that of delamination. The sheath system must be such that components thereof, i.e., the outer jacket and the outer shield do not delaminate during periods of storage on reels in outside areas when subjected to high temperature. Sheath integrity must also be preserved during installation at relatively low temperatures which may be in the range of −15° C.

Still another concern in bonded sheath cables is the ability of the plastic jacket to contact substantially all the surface area of the corrugated shield. This problem is alluded to by E. D. Metcalf in his priorly-identified paper in which he states that the same uniformity of adhesion could not be produced in bonding a plastic jacket to a corrugated shield as could be provided in bonding a jacket to a flat shield.

It appears that the prior art for bonded sheath cables does not provide a solution to the problem of a relatively large pair size cable which is suitable for underground intallation and which has resistance to moisture infusion as well as the capability of resisting buckling during installation and of resisting delamination. In fact, a review of the prior art seemingly would lead one to conclude that the use of a bonded sheath having a jacket bonded to a corrugated shield to achieve moisture resistance and ease of manufacture engenders other problems.

SUMMARY OF THE INVENTION

The foregoing problems have been overcome by cable of this invention which is referred to as one having a bonded sheath and which includes a multipair core, a corrugated, inner metallic shield which is enclosed by a corrugated, outer metallic shield and an outer jacket of plastic material. The inner shield which preferably is made of aluminum has an open longitudinal seam while the corrugated steel shield has an overlapped longitudinal seam. Moreover, the steel which is used to form the outer shield has a copolymer adhesive coating that causes the jacket to bond to the outer shield during extrusion.

The outer steel shield is not only corrugated but also is covered by a plastic material which has particular elongation and bond strength characteristics as well as having a modulus at manufacturing temperatures which manifests itself in excellent corrugation penetration by the plastic. The elongation properties of the plastic are such that it resists rupture notwithstanding the biaxial stressing of the jacket caused by longitudinal bending or twisting together with circumferential bonding. It has been found that the sheath system is essentially notch resistant both longitudinally as imprinted by an edge of the outer shield and circumferentially by the corrugations.

By using a corrugated shield, it has been found that the peel strength of the bonded plastic which is a measure of the ability to resist delamination of the jacket from the shield is substantially greater than that which can be explained because of the increased surface area over that of a non-corrugated shield at least at relatively low temperatures. Moreover, a jacket-flat shield geometry having an unacceptable peel strength is converted to one having more than acceptable peel strength by bonding the same plastic to a corrugated shield. This unexpected result may occur because of the development of a shear mode between the plastic jacket and the corrugated outer shield.

BRIEF DESCRIPTION OF THE DRAWINGS

Other features of the present invention will be more readily understood from the following detailed description of specific embodiments thereof when read in conjunction with the accompanying drawings, in which.

DETAILED DESCRIPTION

Figure 1:
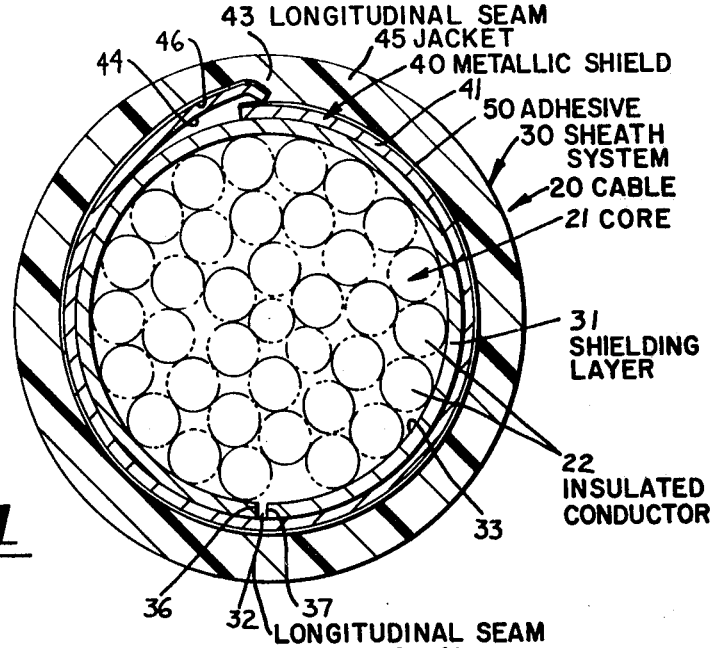
FIG. 1 is a cross-sectional end view of a cable of this invention.

Referring now to FIG. 1, there is shown a cable, designated generally by the numeral 20, said cable comprising a core 21 having a plurality of individually insulated conductors 22—22. The core 21 is enclosed by a core wrap which may be made of a paper tape or of a polyethylene terephthalate laminate, for example.

The core 21 is enclosed in a sheath system which is designated generally by the numeral 30. The sheath system 30 is designed to protect the cable from the ingress of moisture which could degrade the quality of the transmission signals, to protect the cable from mechanical and electrical damage, and to screen the core from electrical interference. The sheath system 30 is also capable of resisting buckling during installation.

Adjacent to the core 21 is a first component of the sheath system 30, said first component being a shielding layer 31. In a preferred embodiment, the first component 31 is wrapped about the core to form a longitudinal seam 32 with an inwardly facing surface 33 facing the core and with an outwardly facing surface oriented toward other components of the system 30. The seam 32 is formed so that longitudinal edge portions 36 and 37 of the layer 31 are either butted together or spaced slightly apart.

The shielding layer 31 is effective to absorb energy from stray electrical fields which emanate from sources outside the cable 20. Typically, the layer 31 is made from a tape of electrical conductor-grade aluminum alloy approximately 0.020 cm thick.

Surrounding the shielding layer 31 is an outer second metallic shield which is designated generally by the numeral 40. The outer shield 40 is used to provide mechanical protection for the cable 20 such as resistance to animal attack or crushing. Also, the shield 40 imparts to the cable suitable strength for resisting buckling during installation of the cable. In a preferred embodiment, the shield 40 is made of an electric chrome-coated or tin-plated steel tape 41 having a thickness of about 0.015 cm.

It should be apparent that while the preferred embodiment of this invention is a sheath system 30 which includes an inner shielding layer 31 and an outer metallic shield 40, the invention is not so limited. For example, there may be instances where only one shield, the shield 40 which is made of a steel-type material having a relatively high modulus of elasticity, is used. Also, the shield 40 because of the material from which it is made and because of its geometry including its thickness has a stiffness which is substantially greater than than of the inner shield 31.

The shield 40 is manufactured by forming the tape 41 about the travelling core 21 with a longitudinal seam 43. This may be accomplished for example with methods and apparatus shown in application Ser. No. 052,165, which was filed on June 26, 1979 in the name of W. D. Bohannon, Jr. and now U.S. Pat. No. 4,308,662. The shield 40 includes an inwardly facing surface 44 which faces the shield 31 and an outwardly facing surface 46 which faces a next successive component of the sheath system 30.

The next successive component of the sheath system 30 and the outermost component thereof is a plastic jacket 45. It has been found that, by bonding the jacket 45 to the outer shield 40, buckling during handling and installation is resisted by the jacket-shield laminate to a much greater extent than in the standard Stalpeth cable. See. G. M. Yanizeski, E. L. Johnson and R. G. Schneider "Cable Sheath Buckling Studies and the Development of a Bonded Stalpeth Sheath" pp. 48–58 *Proceedings 29th International Wire and Cable Symposium,* November 18–20, 1980. In order to provide the cable with a sheath system which is suitable for resisting buckling and for preventing the infusion of moisture, the shield 40 may include an adhesive-like material 50 which is precoated at least along its outwardly facing surface. Then when the jacket 45 of a plastic material, usually polyethylene, is applied over the steel shield 40, the heat of extrusion causes the jacket to become bonded to the outwardly facing surface of the steel shield.

The material 50 which is used to precoat the steel shield 40 is an adhesive material which has the ability to develop firm adhesion to and prevent corrosion of the steel. The bonding of the shield 40 to the jacket 45 over a substantial portion of the outwardly facing surface of the shield results in a sheath system 30 which inhibits the penetration of moisture into the cable core. In one embodiment, the material 50 is comprised of an ethylene acid copolymer and a strip which is precoated with same is available from commercial sources. For example, the combination of a metallic strip which is precoated with an ethylene acrylic acid copolymer adhesive-like material is marketed by the Dow Chemical Company of Midland, Michigan, under designations X0-5554.21 and X0-5554.28 and is referred to as Zetabon® plastic clad metal sheathing for electrical wire and cable.

Figure 2:
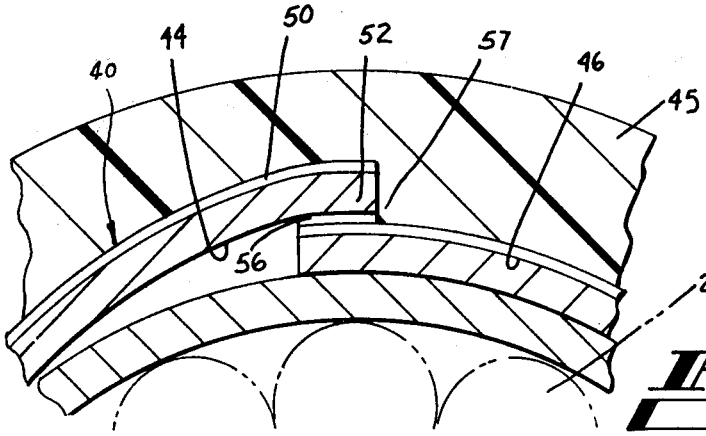
FIG. 2 is a detail view of a longitudinal seam of a shield of one embodiment of this invention.

The precoating of the corrugated steel shield 40 may be accomplished in several different configurations. In one embodiment which is shown in FIG. 2, the surface 46 of the tape which is to become the outwardly facing surface of the steel shield 40 and an edge portion 52 which is to be a portion of the inwardly facing surface are precoated with the material 50 prior to the step of forming the tape about the shielded core 21.

By applying a strip 56 of the adhesive material 50 along the edge portion 52 of the tape and by coating the entire outwardly facing surface 46 with an adhesive copolymer, the adjacent portions of the overlapped portions form a sealed longitudinal seam 57. This creates an effective tubular barrier to moisture penetration into the core. The resistance of the cable 20 to moisture penetration is also enhanced by the bond created between the precoated outwardly facing surface of the shield 40 and the jacket 45. As discussed hereinbefore, in order to effectively bond the facing surface areas of the overlapped portions of the outer shield 40, it may become necessary to flow additional adhesive-like material between the overlapped portions. However, if there is sufficient contact between the jacket 45 and the shield 40, a sealed seam is not necessary to achieve acceptable resistance to moisture diffusion.

It is important to recognize that while in some cables the outer shield is coated with this adhesive-like material, such as an acrylic acid copolymer, other arrangements come within this invention. For example, it is well known that an improved bond is established between a polyethylene jacket and a polyethylene coated metallic shield. Consequently, it has been suggested that the outer shield be precoated or coextruded with dual layers—one of the acrylic acid copolymer and the other, a typical polyethylene. This construction is disclosed in U.S. Pat. No. 4,132,857 which issued on Jan. 2, 1979, in the name of L. S. Scarola.

Figure 3A:
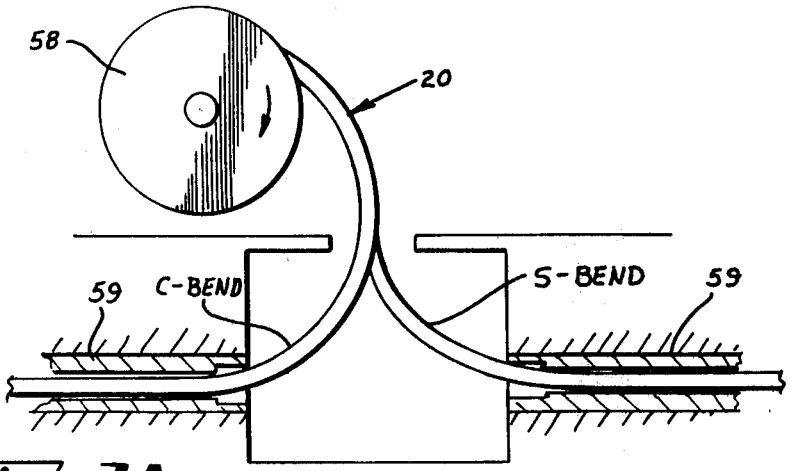
FIGS. 3A and 3B are a series of views in elevation showing methods of cable installation.
Figure 3B:
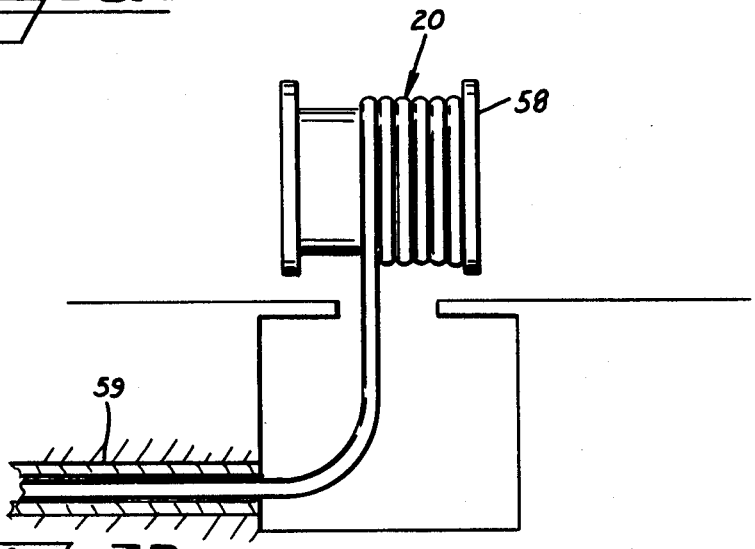

The sheath system 30 must provide sufficient strength for the cable 20 so that it is capable of resisting buckling particularly during any of three commonly used techniques (see FIG. 3) for installing cables from reels 58—58 in underground duct 59. In the first (see FIG. 3A), the so-called C-bend configuration, compressive strains, which cause buckling, are generated as the cable 20 is straightened and its reel set is overcome. In an S-bend configuration (see again FIG. 3A), the cable sustains bending beyond that needed to straighten the cable and additional compressive strains are generated. In a side payout, high production procedure in which reels are mounted on a flat bed tractor trailer (see FIG. 3B), the cable 20 undergoes bending and torsion as the cables comes off the top of the reel 58 and then turns to enter the duct 59. Side payout is the most severe configuration as far as buckling is concerned while the C-bend is the least severe.

The plastic material comprising the jacket 45 is characterized in terms of particular properties which provide excellent resistance to damage to the cable during handling and installation and which prevents delamination of the jacket 45 from the steel shield 40. The plastic material which is used to make the jacket 45 must have suitable elongation properties to resist rupture when subjected to biaxial stress and notching in a bonded sheath system. This, it will be recalled, becomes important to the integrity of the bonded sheath system of this invention under field conditions.

Figure 4:
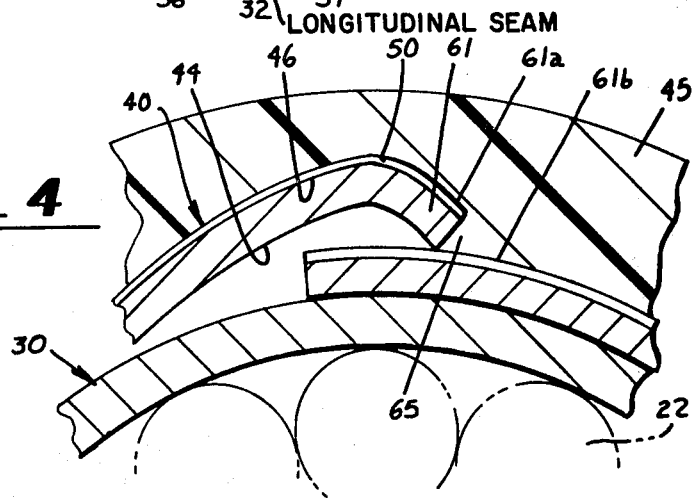
FIG. 4 is an enlarged view in section of a portion of the preferred embodiment of the cable of FIG. 1.

These properties also become important to the preferred embodiment of the sheath system of this invention in which the longitudinal seam is not intentionally bonded (see FIG. 4). In fact, a longitudinal edge portion 61 of the tape is directed inwardly toward an underlying portion as the tape is formed into the shield 40. This is done in order to prevent the outer overlapping edge portion which forms a step discontinuity in jacket thickness along its longitudinal edge from undesirably protruding into the plastic jacket 45. Methods and apparatus for forming a longitudinal seam with an outer edge portion turned inwardly are disclosed in the hereinbefore-identified W. D. Bohannon Jr. application.

The plastic material of the jacket 45 is characterized by a biaxial stress resistance which provides the capability of sustaining stresses across the longitudinal seam of the outer shield. In the unsealed seam embodiment which is shown in FIG. 4, the overlapped edge portions of the coated metallic shield 40 are free to move relative to each other in the circumferential direction except as confined by the jacket 45 as the cable 20 is handled and installed. This elongation property of the plastic jacket 45 prevents jacket splitting in the field during installation and is particularly significant in view of the "bridging" of the plastic adjacent to the longitudinal edge of the outer edge portions of the outer shield. Since hoop strength is not provided by the shield 40 across the seam, it must be provided by a portion 65 of the plastic jacket 45 which bridges between the portion 61*a* and the inner portion 61*b* of the overlapped seam.

The ability of the cable jacket to resist jacket splitting can be related to a sufficiently low notch sensitivity. Notching of the jacket occurs both in a longitudinal and in a circumferential direction. First, in the longitudinal direction, the overlapping of the longitudinal edge portions of the outer steel shield 40 causes the outer edge portion to protrude into the jacket to notch the jacket 45 in a longitudinal direction. This, of course, can be minimized by directing the outer edge portion 61 inwardly toward the core, but at the very least there will be a notching equal to the thickness of the shield. Secondly, there is a notching in a circumferential direction caused by the peaks of the corrugations of the outer shield 40. These corrugations have a range of depth with the maximum peak to valley height of about 0.13 cm and are formed at a predetermined number per unit of length which may be on the order of about four per centimeter. Also, since as will be recalled the bonding of the shield sets up hoop stresses during installation, the bonding of a corrugated shield further aggravates the stresses caused by notching.

Notch sensitivity is a material property which is defined in terms of the amount of elongation that a material can sustain when subjected to a notch of defined sharpness. The elongation characteristics of the cable jacket material may also be defined as a function of the sharpness of the notch. The sharpness of the notch is defined as the quotient of the radius of curvature $\rho$ of the configuration of the notch and the depth of the notch. The smaller the ratio of $\rho/d$, the sharper the notch. This quotient may be plotted against the elongation with a typical graph being shown in FIG. 5. The elongation of cable jacket materials may also be plotted as a function of temperature. See for example FIG. 9 of C. J. Aloisio and G. S. Brockway "Thermomechanical Reliability of Plastics in Transmission Media" pp. 158–163 *Plastics and Rubber Materials and Applications* November 1979. It has been found that the jacket material of the cable of this invention has a low notch sensitivity which means that it exhibits a relatively high elongation even when sharply notched.

Figure 5:
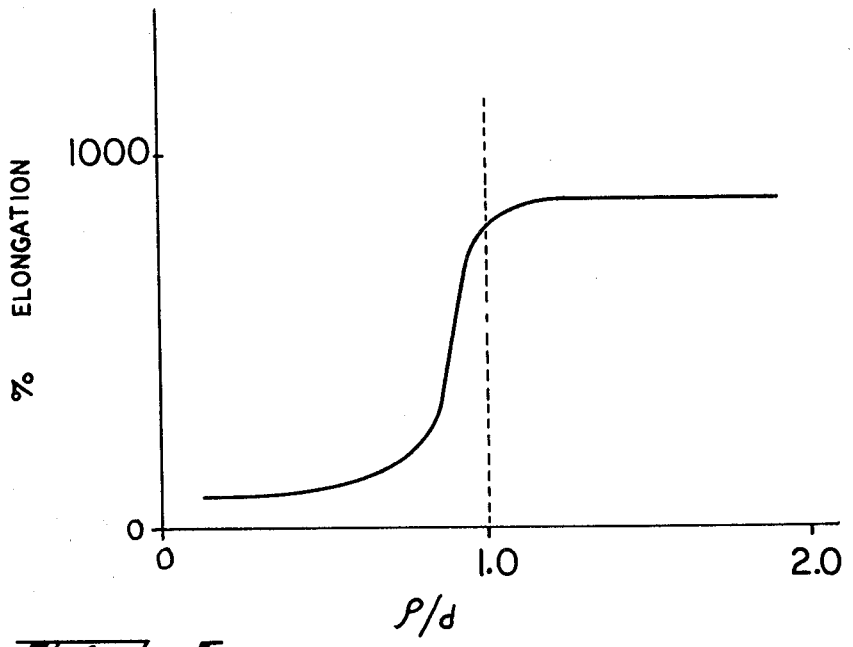
FIG. 5 is a graph of elongation versus a characteristic of notch sensitivity.

It has been found that the plot of elongation versus $\rho/d$ for jacketing grade plastic materials is stepped with relatively sharp transitions between steps. While the graph of elongation and $\rho/d$ which is depicted in FIG. 5 is characteristic of commonly used jacketing materials, the transition points from one elongation value to another shift for different materials. The significance of a transition point is that to one side of it, the plastic behaves in a ductile manner while on the other side, it behaves in a brittle manner. These transitions are influenced by temperature as well as by the bonding of the jacket 45 to the outer shield 40. A sharp notch creates a biaxial state of stress which is aggravated in a bonded sheath environment. With an unbonded arrangement, elongation can occur over a longer distance whereas in the bonded sheath arrangement it can occur only where the jacket 45 bridges the seam. For jacketing plastics, which are typically used in the communications industry, it is desirable to operate at elongations in the range of 600 to 1000%. Once an operating level of elongation is selected, then the $\rho/d$ of the plastic material of the jacket should occur to the left of that operating range.

It has been found that plastic materials having a transition point in elongation which occurs to the left (see FIG. 5) of a sharpness ratio $\rho/d$ value of about 0.7 at room temperature, i.e. about 23° C., provides suitable notching resistance for the cable of this invention in the expected range of installation temperatures, i.e. about −15° C. to 70° C. On the other hand, a material having a transition point to the right of a $\rho/d$ value of 3.5 is not suitable for bonded sheath construction. A material which has been found to meet this requirement is one marketed by the Union Carbide Company and designated DFDA 6059 polyethylene.

There are a number of plastic jacketing materials such as polyethylene, for example, which exhibit elongation in the range of 600 to 1000% when uniaxially stressed. However, many of these experience a severe decrease in elongation to the range of perhaps 50% or less when stressed biaxially, often in the range of temperatures to which cables are exposed during installation. This range may extend from a low of about −15° C. to a high of about 70° C. which may be reached during storage without a protective thermal wrap or after having had the thermal wrap removed and positioned adjacent to a manhole for an hour or more awaiting installation. The cable 20 of this invention includes a sheath system which provides the desired elongation within the said temperature range.

In order to take full advantage of the precoated outer shield 40, which it will be recalled is corrugated, contact of a substantial portion of the area of the outer surface 46 area of the outer shield with the jacketing material must be made. The jacketing material must be such that it has excellent penetration, a property which indicates to those skilled in the art that it is capable of being flowed into the valleys of the corrugations of the shield under manufacturing conditions so that it contacts substantially all the outer surface areas of the outer shield.

Figure 6:
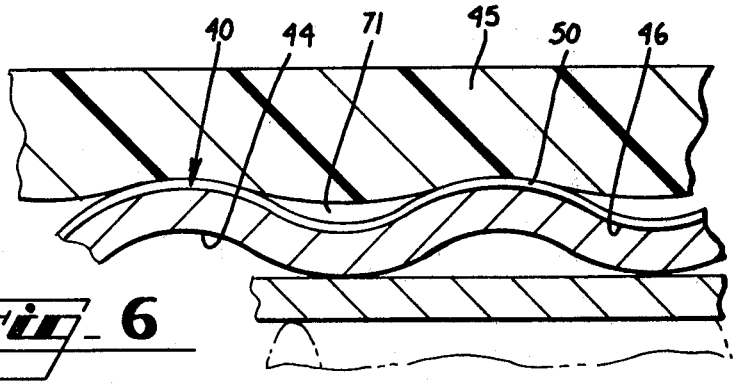
FIG. 6 is an enlarged view to show a portion of a shield in which jacket plastic lacks suitable penetration.

Penetration of the corrugations by the jacketing material is also important with respect to the ingress of moisture. If the corrugations are not filled, the plastic spans from one peak to another and creates a void 71 between it and the bottom of the valley (see FIG. 6). This provides a path by which moisture can diffuse through the jacket, then travel circumferentially about the cable and enter the core through the seam. It has been found that if the jacketing material penetrates and fills the corrugations and forms a substantial bond with the shield, sufficient diffusion resistance is obtained notwithstanding the absence of a bonded seam.

Sufficient penetration of the corrugations by the plastic jacketing material and the development of a relatively high bond strength not only ensure a relatively high degree of diffusion resistance, but they are also important to the continued integrity of the sheath system during the time before installation when the cable is stored. Cables of this type are typically pressurized and stored in outdoor areas where the cable may be subjected to relatively high temperatures. Without excellent penetration and bond properties, the internal cable pressure may cause the jacket material to delaminate from the steel.

This property of the jacketing material provides excellent results which contribute to the buckling resistance of the cable of this invention. The corrugated construction of the outer shield cooperates with a jacketing material having excellent penetration to provide a cable sheath system in which the jacket is superbly bonded to the shield. Particularly at lower temperatures, the ability of a sheath system comprising corrugated metal covered with a plastic which penetrates the corrugations to resist delamination exceeds that of the plastic to an uncorrugated strip of metal, being an order of magnitude larger than the ratio of surface area of a corrugated to an uncorrugated shield. In fact, because of this synergistic effect of corrugating the outer shield, which may be termed the "corrugation effect," the sheath system of this invention resists buckling notwithstanding an incomplete fill of the corrugations of the outer shield.

The capability of a plastic material to fill corrugations is a function of its modulus at manufacturing temperatures. The modulus of plastic is the time dependent stress for a fixed unit strain, that is, it is the time dependent coefficient of proportionality between stress and strain. The elastic and viscous components of the modulus, which can be measured as a function of frequency in tension or in shear, is a property independent from that of elongation. Two jacketing materials may have the same modulus but have different elongation properties.

As the cable 20 is advanced through a cooling trough (not shown) for a time period of about 30 seconds, the plastic jacket forms an outer crystallized skin because of its contact with the water while the inner layer remains molten. If the modulus is sufficiently low, then with only a slight driving force in the outer layer, the inner layer of melt is pushed inwardly to the corrugations. The polymer layer which is in contact with the water shrinks upon crystallization and provides the driving force to achieve excellent corrugation fill. If the modulus of the polymer in the inner layer is sufficiently low, then the diametral decrease of the outer layer due to crystallization and/or thermal contraction is more than adequate to cause the inner layer to fill the corrugations.

It has been found that if a plastic jacketing material is such that after having been heated to a temperature of about 180° C. and then cooled to about 115° C. at a rate of about 5° C./minute, its elastic shear modulus G' is less than $1.4\times10^5$ Pascals at 10 $sec^{-1}$ after at least one minute, excellent penetration is achieved. This requirement is exemplified by a plastic material such as that shown in FIG. 7.

Figure 7:
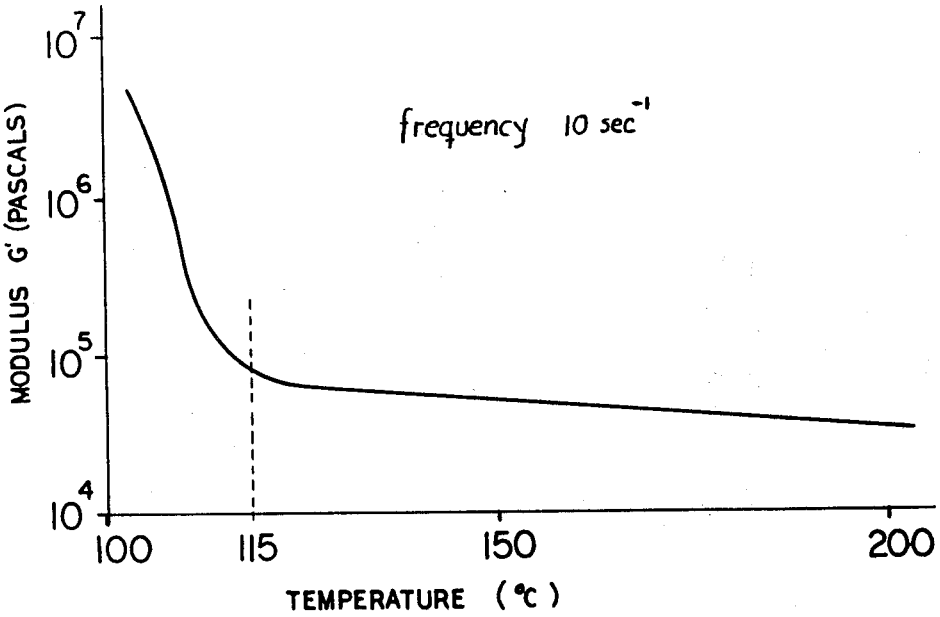
FIGS. 7 and 8 are graphs of characteristics of a plastic jacketing material which forms the jacket of the cable of this invention.
Figure 8:
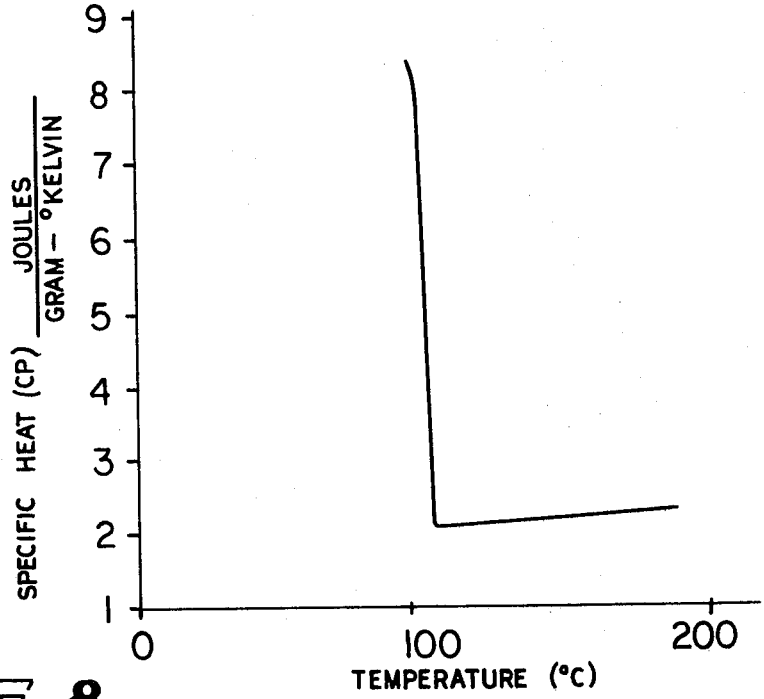

Differential scanning calorimetry (DSC) may be used to screen polyethylenes suitable for jacketing. The modulus enhancement which is shown in FIG. 7 is accompanied by an increase in specific heat, Cp, as is illustrated in FIG. 8. A requirement for the jacketing material to insure excellent corrugation fill also may be set forth as one in which after heating to a temperature of about 180° C., crystallization, which is represented by the increase in specific heat, does not occur above 110° C. upon cooling at a rate of 10° C./minute.

The sheath system of this invention produces some surprising results. It will be recalled that the biaxial stress condition which is far worse for the plastic to experience than uniaxial stress is aggravated in a bonded sheath construction. This would seem to indicate that the greater the bonded area of jacket to shield, the more the jacket is apt to rupture. Seemingly, it would follow that a decision would have to be made to compromise the water resistant properties of the bonded sheath construction to alleviate the biaxiality of the stress. Surprisingly, the sheath system of the cable of this invention includes a jacket material which substantially completely penetrates the corrugations of the outer shield 40 to maximize the bonded area and to optimize the cable's resistance to moisture penetration, and which at the same time exhibits excellent resistance to rupture because of its priorly discussed $\rho/d$ properties.

A third characteristic of the plastic material of the jacket relates to bond strength. One measure of the bond strength of the cable and its ability to resist delamination is peel strength. Peel strength which is determined by measuring the force required to separate jacket plastic from a steel strip provides an indication of the ease with which the jacket may be pulled from the steel shield. Peel strength is a function of the adhesion between interfaces such as between the adhesive layer 50 and the shield 40 or between the adhesive layer 50 and the jacket 45. It is also a function of the degree of contact between the surfaces, of the mechanical properties of the plastic material of the jacket, of the mechanical properties of the adhesive coating material, of the sheath geometry, of the temperature and of the rate of separation.

The bond strength of the jacket plastic to the outer shield is important in order to be able to withstand jacket buckling during installation as well as the effects of gas pressurization over a temperature range of about −15° C. to about 70° C. Although buckling performance is important over this entire temperature range, the stresses causing buckling are greatest at the low end of the range. Bond strength of the jacket 45 to the shield 40 is important to the integrity of the sheath system when the cable is stored on reels in outside areas and subjected to relatively high temperatures, which may reach 70° C. However, it is possible to protect the cable with a thermal wrap that will maintain the temperature below 50° C. The cable must be capable of resisting delamination while covered with the thermal wrap for periods of as long as a year when stored in outside areas and after the thermal wrap has been removed in preparation for installation and the cable is exposed to temperatures which may be as high as 70° C. It is also important when the cable is in place in ducts of underground and subjected to temperatures on the order of 10° C. to 30° C. for long periods of time such as 30 to 40 years for example. With the cable core being gas pressurized on the order of $7\times10^4$ Newtons/$m^2$ the jacket and shield can delaminate particularly when the cable is exposed to relatively high temperatures for relatively short periods of time. It has been found that plastics which are capable of withstanding high temperatures for short periods of time are capable of withstanding low temperatures for a long period of time.

The sheath system must also provide sufficient strength for the cable so that it is capable of resisting buckling particularly during any of three commonly used priorly described techniques (see FIG. 3) for installing cables in underground duct. Failure occurs because the jacket plastic separates from the underlying adhesive layer 50 or the adhesive layer from the underlying metallic shield 40 and buckles. By reliably bonding the jacket 45 to the shield 40, the jacket-shield laminate performs as a unit and successfully resists separation and rupture.

What is needed is a sheath system which provides long term bond strength between the jacket 45 and the shield 40. Any adhesive precoat or coextruded layer on the steel shield must be capable of bonding the jacket to the shield. The resulting sheath must be such that it does not buckle during installation at low temperatures nor delaminate when under pressure at high temperatures. Further, it must be such that the bond is not degraded to any substantial degree if the shield is exposed to moisture.

The bonding of the jacket plastic of the cable of this invention to the outwardly facing surface of a corrugated steel shield results in a sheath having such long term bond strength as to provide increased resistance to delamination of the jacket from the shield. Of course, in order to achieve the bonding of the jacket 45 to the outer shield 40, there must be substantial corrugation fill. As will be recalled, the cable of this invention includes a plastic jacket 45 which achieves excellent penetration of the corrugations of the shield 40.

The successful performance of the bonded sheath system of this invention depends not only on the adhesive 50 for adhering the jacket 45 to the shield 40 but also the material comprising the jacket. For acceptable resistance to buckling during installation at low temperatures, the priorly discussed corrugation effect becomes important. Tests conducted at rates to simulate installation have shown that the peel strength of the jacket 45 of the cable of this invention from the shield 40 at a temperature of about −15° C. is on the order of 10 to 20 times that required to peel the same plastic from a flat metal strip. It should be apparent that the peel strength of the sheath system of a cable of this invention is not solely a function of the adhesive coating of the outer shield, rather it is a function of the structure of the sheath system and the properties of the jacket as well as of the adhesive system.

EXAMPLE NO. 1

A cable made in accordance with this invention included a core comprising 616 pairs of 24 gauge copper conductors each covered with plastic insulating material. The cable core was made in a 180 meter length and was enclosed with an aluminum inner shield followed by a tin coated, copolymer coated Zetabon ® steel strip available from the Dow Chemical Company under its designation XO-5554.21. The steel strip was 0.015 cm thick with a 0.005 cm coating of the copolymer adhesive on each side. Further, the steel, copolymer-coated strip was corrugated and formed with 3.7 corrugations per cm and with each corrugation having a depth of about 0.06 cm. The steel outer shield was enclosed in a 0.23 cm thick jacket comprising a polyethylene material available from the Union Carbide Company under its designation DFDA 6059. The jacketed cable had an outside diameter of about 6.9 cm.

The cable of this example was pressurized at $7\times10^4$ Newtons/sq. m. for 60 days at a temperature exposure of 71° C. and exhibited no delamination despite the absence of a bonded seam. In another test called re-reeling, the cable was moved at 30 m/min in an S-bend path (see FIG. 3) after having been exposed to a temperature of −13° C. for 24 hours and exhibited no buckles nor jacket imperfections except one slight dent. In another test conducted in accordance with ASTM D-1876-72, the cable of this example exhibited a minimum T-peel strength of 4 kg/cm and a maximum peel strength of 14 kg/cm when measured at 22° C.

EXAMPLE NO. 2

A cable made in accordance with this invention included 1800 pairs of 24 gauge pulp-insulated copper conductors. The cable which had an outside diameter of 7.5 cm included an electrolytically chromate coated 0.015 km thick steel strip provided by the Dow Chemical Company under its designation XO-5554.28 with a 0.015 cm adhesive coating on each side. The strip was corrugated to have 3.7 corrugations per cm with a center of peak to center of valley height of 0.10 cm and was formed into a shield having an overlapped seam which was bonded. The jacket material is a material similar in properties to the Union Carbide 6059 material. The jacket thickness was 0.23 cm.

In testing the cable of example 2 for T-peel strength in accordance with modified ASTM D-1876-72 at a rate of 50 mm per minute, it was found that at a temperature of about −12° C. the sheath exhibited bond strengths of about 5 kg/cm. Similar tests of an uncorrugated steel-adhesive-polyethylene composite which included similar materials having the same thickness yielded a bond strength of about 0.4 kg/cm. Corrugated steel adhesive-polyethylene laminates which were laboratory prepared exhibited substantially the same bond strengths as the example cable. As the temperature increases, the so-called corrugation effect is not a factor in contributing to the bond strength and at about 50° C., the cable sheath exhibited about the same bond strength as an uncorrugated steel-adhesive-polyethylene laminate. Then at a temperature of about 60° C., whereat there is no corrugation effect and the bond strength appears to become dependent primarily on the properties of the adhesive system and of the plastic material of the jacket, the bond strength was found to be about 2.2 kg/cm. The cable was pressurized to $7\times10^4$ Newtons/$m^2$ and after 30 days at a temperature of 60° C. and after 13 days at a temperature of 71° C. exhibited no delamination.

It should be understood that the just described embodiment merely illustrates principles of the invention in one preferred form. Many modifications, deletions and additions may, of course, be made thereto without departure from the spirit and scope of the invention as set forth in the following claims.

What is claimed is:

1. A bonded sheath cable, which comprises:

a core which includes a plurality of conductors; and a sheath which encloses and which is juxtaposed with said core, said sheath including:

a corrugated steel shield which encloses said core, said shield having inwardly and outwardly facing major surfaces with an overlapped seam having overlying and underlying portions formed between overlapping adjacent longitudinal edge portions of said shield, said shield being formed with at least the longitudinal edge portion of the inwardly facing surface of said overlying portion being substantially juxtaposed to the outwardly facing surface of the underlying portion of said shield; and a jacket which is made of a plastic material and which is adhesively bonded to substantially all of said outwardly facing surface of said corrugated metallic shield with a bond strength which is sufficient to prevent delamination and buckling of the sheath in a temperature range of about −15° C. to about 70° C., said jacket plastic which is notched circumferentially by said corrugated shield and longitudinally by said overlapped seam being made of a plastic material having elongation properties sufficient for the jacket to resist rupture caused by corrugation and seam notching when said jacket is biaxially stressed in said range of temperatures.

2. The cable of claim 1, wherein said plastic material which comprises said jacket has a transition point in elongation at a temperature of about 23° C. which occurs at a sharpness ratio value of less than about 0.7.

3. The cable of claim 1, wherein said shield includes an adhesive material which is coated along at least said outwardly facing surface of said shield, said adhesive material being effective to bond said jacket to said shield.

4. The cable of claim 1, wherein said plastic material which comprises said jacket has a sufficiently low elastic modulus in shear at a temperature in the range of about 115° C. such that it engages substantially all the outwardly facing surface of the corrugated metallic shield.

5. The cable of claim 4, wherein said elastic modulus in shear is less than about $1.4\times10^5$ Pascals at a frequency of 10 cycles per second after at least 1 minute after having been cooled at a rate of 5° C./min from a temperature of about 180° C. to a temperature of about 115° C.

6. The cable of claim 4, wherein said plastic jacketing material is crystalline and crystallization of said plastic jacket material does not occur above a temperature of about 110° C. upon cooling the plastic material at a rate of 10° C./minute from about 180° C.

7. The cable of claim 1, wherein said seam is unbonded and said outer longitudinal edge portion of said shield is directed inwardly toward a centerline of said core.

8. The cable of claim 1, wherein said corrugated shield has a thickness in the range of about 0.015 cm.

9. A bonded sheath cable, which comprises:

a core; and a sheath which encloses and which is juxtaposed with said core, said sheath including:

a corrugated shield which is made of a metallic material characterized by a modulus of elasticity in the range of about 27 to $33\times10^6$—psi, and which has a relatively high stiffness, said shield having inner and outer surfaces with an overlapped seam having overlying and underlying portions formed between overlapping adjacent longitudinal edge portions of said shield, said shield being formed with at least the longitudinal edge portion of the inner surface of said overlying portion being substantially juxtaposed to the outer surface of the underlying portion of said shield; and a plastic jacket which is adhesively bonded to substantially all of said outer surface of said shield with a bond strength which is sufficient to prevent delamination and buckling of the sheath in a temperature range of about −15° to about 70° C., said jacket, which is notched circumferentially by said corrugated shield and longitudinally by said overlapped seam, being made of a plastic material which has elongation properties sufficient for the jacket to resist rupture caused by corrugation and seam notching when said jacket is biaxially stressed in said range of temperatures, and having a stiffness which is less than that of the corrugated metallic shield.

* * * * *